US007478799B2

(12) United States Patent
Viviano

(10) Patent No.: US 7,478,799 B2
(45) Date of Patent: Jan. 20, 2009

(54) RAILING SYSTEM

(76) Inventor: Robert P. Viviano, 35 Fairhaven Rd., McKees Rocks, PA (US) 15136

( * ) Notice: Subject to any disclaimer, the term of this patent is extended or adjusted under 35 U.S.C. 154(b) by 0 days.

(21) Appl. No.: 11/583,496

(22) Filed: Oct. 19, 2006

(65) Prior Publication Data

US 2008/0093588 A1 Apr. 24, 2008

(51) Int. Cl.
*E04H 17/00* (2006.01)

(52) U.S. Cl. ..... 256/65.12; 256/59; 256/65.11; 403/167

(58) Field of Classification Search ..... 256/19, 256/21, 22, 59, 65.02, 65.11, 65.12, 67; 403/167, 403/168, 206, 208
See application file for complete search history.

(56) References Cited

U.S. PATENT DOCUMENTS 1,757,686 A * 5/1930 Rosenbaum ..... 256/19
2,656,087 A * 10/1953 Sharrock ..... 403/168
3,095,184 A * 6/1963 Boxberger ..... 256/22
4,027,855 A * 6/1977 Lauzier ..... 256/21
5,002,260 A * 3/1991 Lustvee ..... 256/22
5,649,688 A * 7/1997 Baker ..... 256/21
5,873,564 A * 2/1999 Bisch ..... 256/65.12
7,021,607 B1 * 4/2006 Alexander ..... 256/65.11
2007/0221903 A1 * 9/2007 Robbins ..... 256/65.12

* cited by examiner

*Primary Examiner*—Michael P Ferguson
(74) *Attorney, Agent, or Firm*—Carothers & Carothers

(57) ABSTRACT

A railing system having a thin profile balustrade for minimum obstruction of the view therebeyond. The railing system includes spaced parallel upper and lower rails which are supported in conventional fashion from upright posts. The balustrade is made of a plurality of parallel upright rod balusters extending between the rails and having upper and lower bent ends. Upper and lower elongate channels are provided and they respectively extend with the upper and lower rails. Each channel has an open side which is respectively secured against the bottom side or inside of the upper rail and the top side or inside of the lower rail, thereby providing an enclosed elongate passage in the channels. Spaced apertures are provided in the channels and receive the bent rod ends therethrough with the bent ends received in the channel passages for retention therein.

6 Claims, 8 Drawing Sheets

RAILING SYSTEM

BACKGROUND OF THE INVENTION

This invention relates to railing or hand railing systems, and more particularly to railing systems which have minimal profile as to not inhibit a view being observed beyond the railing.

It has been an object of railing manufacturers to provide railing systems with thin low profile balusters so as not to block the scenic view beyond the railing. To accomplish this objective, some manufacturers provide wooden railings with thin wooden balusters. However, such thin wooden balusters are prone to breakage and are not sufficiently thin.

Another approach has been to provide balusters manufactured of stainless steel wire rope. The wire rope balusters are provided either as horizontal balusters or vertical balusters. Vertical balusters are preferable, and in fact, in some localities the horizontal balusters are not in conformity with the local building code. This is because children have a tendency to climb the horizontal balusters as a ladder and can be harmed by falling over the railing.

The wire rope balusters require the use of expensive connectors in order to connect the stainless steel wire rope ends to the rails and they are also time consuming, and therefore expensive, to install.

It is accordingly an object of the present invention to provide a low profile balustrade which is inexpensive to manufacture, easy to install and maintenance free.

SUMMARY OF THE INVENTION

The railing system of the present invention includes spaced parallel upper and lower rails, with each rail having top and bottom sides. The rails are supported between spaced upright posts in conventional fashion. A plurality of parallel upright rod balusters extend between the rails and have upper and lower bent ends. In addition, upper and lower elongate channels are provided and respectively extend with the upper and lower rails. Each of the channels has an open side which is respectively secured against the bottom side of the upper rail and the open side bottom channel is secured against the top side of the lower rail, thereby providing an enclosed elongated passage in the channels. Spaced apertures in the channels receive the bent rod ends therethrough with the bent ends received in the channel passages for retention therein.

The spaced parallel rails are either installed horizontally or on a slope to follow a set of stairs. When the rails are horizontal the bent ends of the rod balusters are at right angles to the rod balusters so that they are received within the channel passages. When the rails are inclined, the bent ends of the rod balusters are inclined at the same angle to likewise be retained within the channel passages.

Elastomeric material is positioned in each channel between the bent ends and the channel in order to avoid rattling or metal to metal contact. The elastomeric material can be provided in the form of a strip having apertures therethrough which are aligned with the channel apertures. Normally the apertures are provided at regular intervals to provide uniform spacing for the baluster rods.

The bent rod ends of each rod baluster may be bent in the same direction or in opposite directions. It has been found that it is more convenient for installation and manufacturing purposes to have the bent rod ends of each baluster rod bent in opposite directions.

The rod balusters are preferably manufactured of low maintenance stainless steel. However, painted steel rods or rods manufactured of other material, such as plastic, are acceptable. The rods may take on any dimension, such as round, square, oblong etc. in cross section. In fact, the rod balusters may be tubular. Similarly, the channels may also be manufactured of stainless steel or any other suitable material such as painted carbon, steel or plastic, and the channels may have any desired cross section, such as U-shaped, C-shaped, oval, rectangular or square.

BRIEF DESCRIPTION OF THE DRAWINGS

Other objects and advantages appear hereinafter in the following description and claims. The accompanying drawings show, for the purpose of exemplification, without limiting the invention or claims, certain practical embodiments of the present invention wherein:

DETAILED DESCRIPTION OF THE PREFERRED EMBODIMENTS

Figure 1:
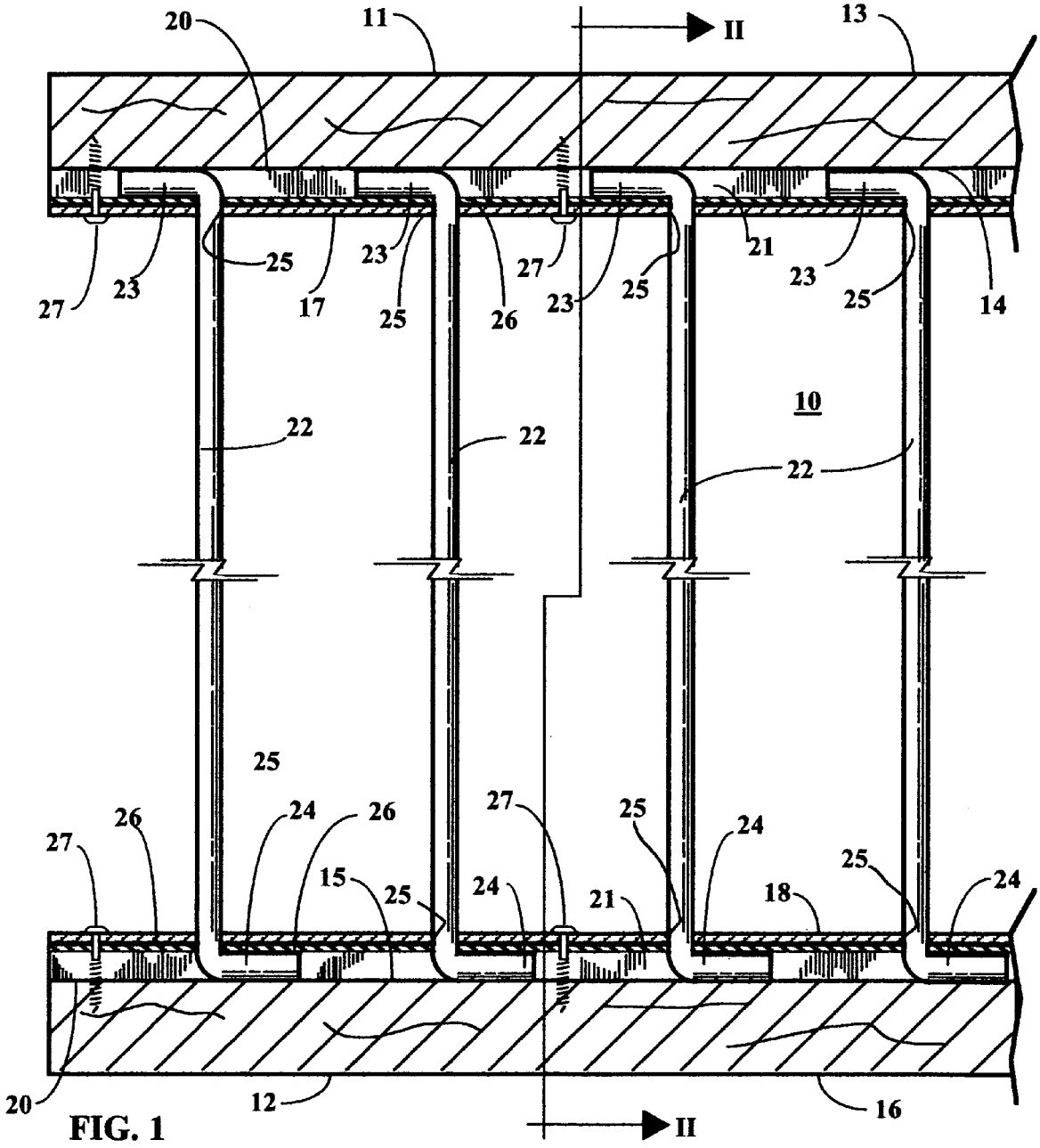
FIG. 1 is a view in front elevation of the railing system of the present invention as seen along section line I-I of FIG. 2.
Figure 2:
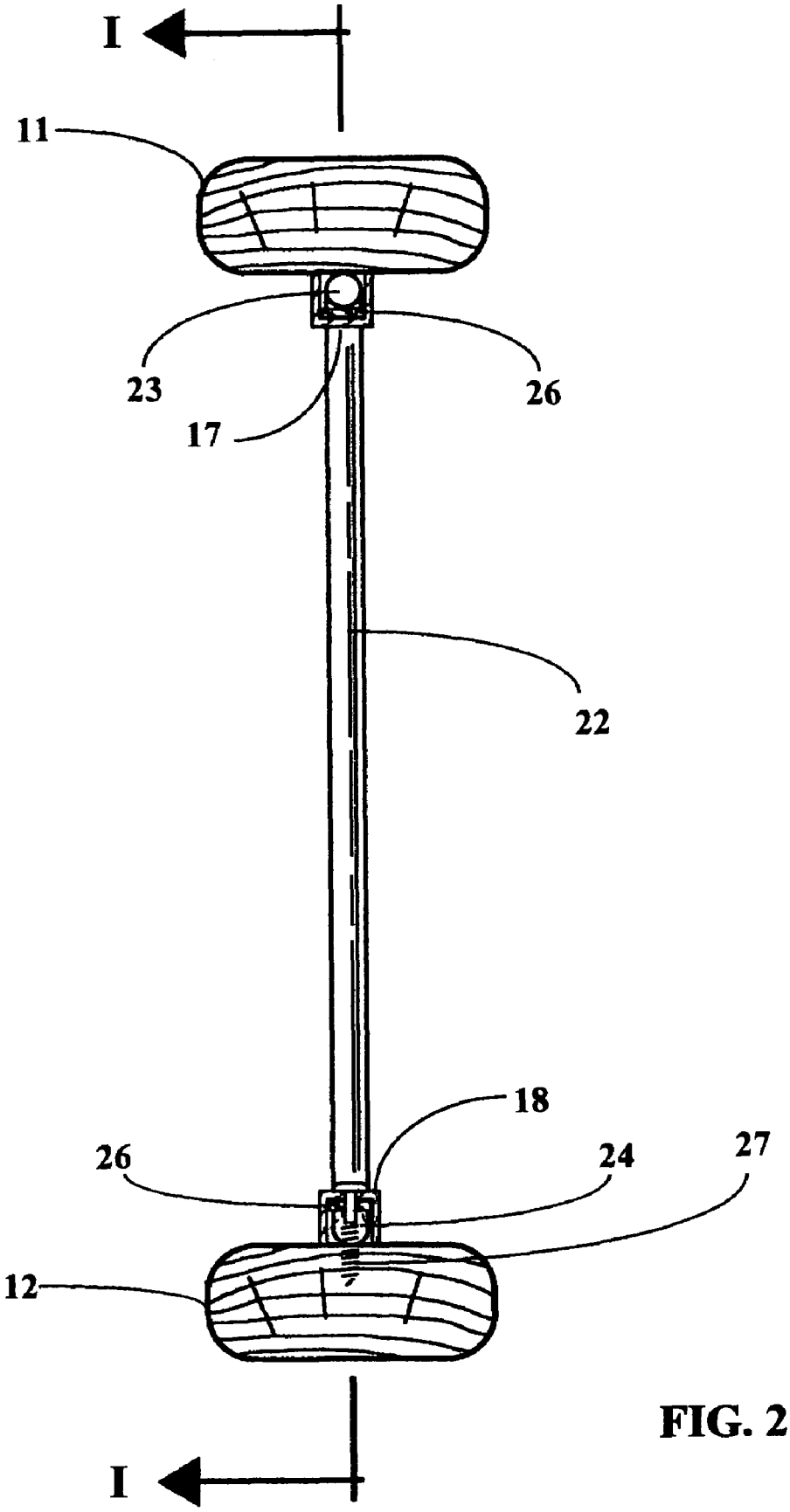
FIG. 2 is an end view in vertical cross section of the railing system shown in FIG. 1 as seen along section line II-II.
Figure 3:
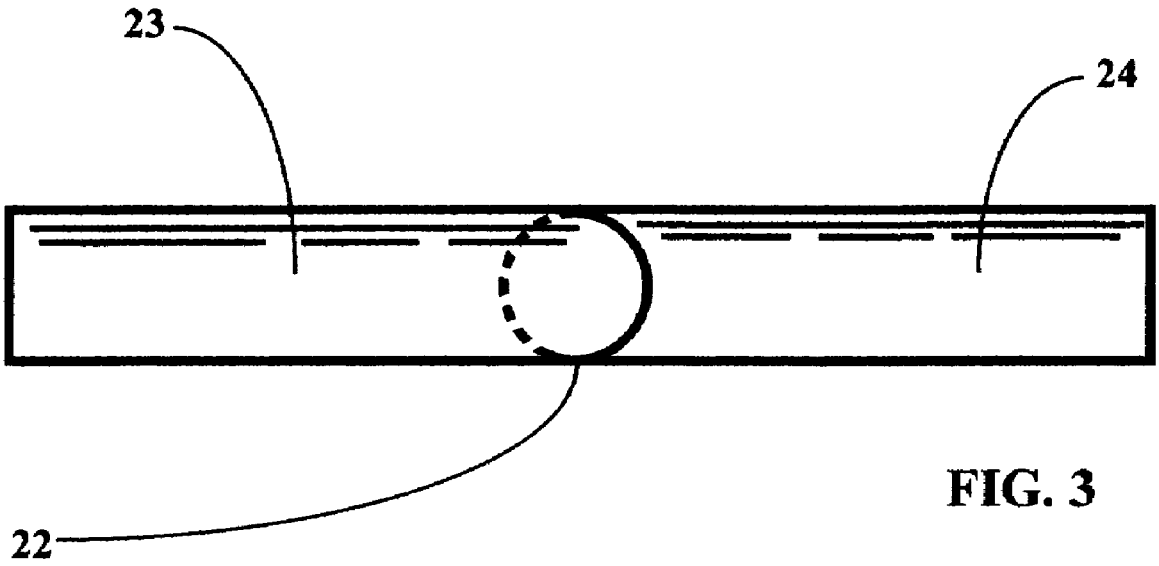
FIG. 3 is a top view of one of the rod balusters of the railing system shown in FIGS. 1 and 2.
Figure 4:
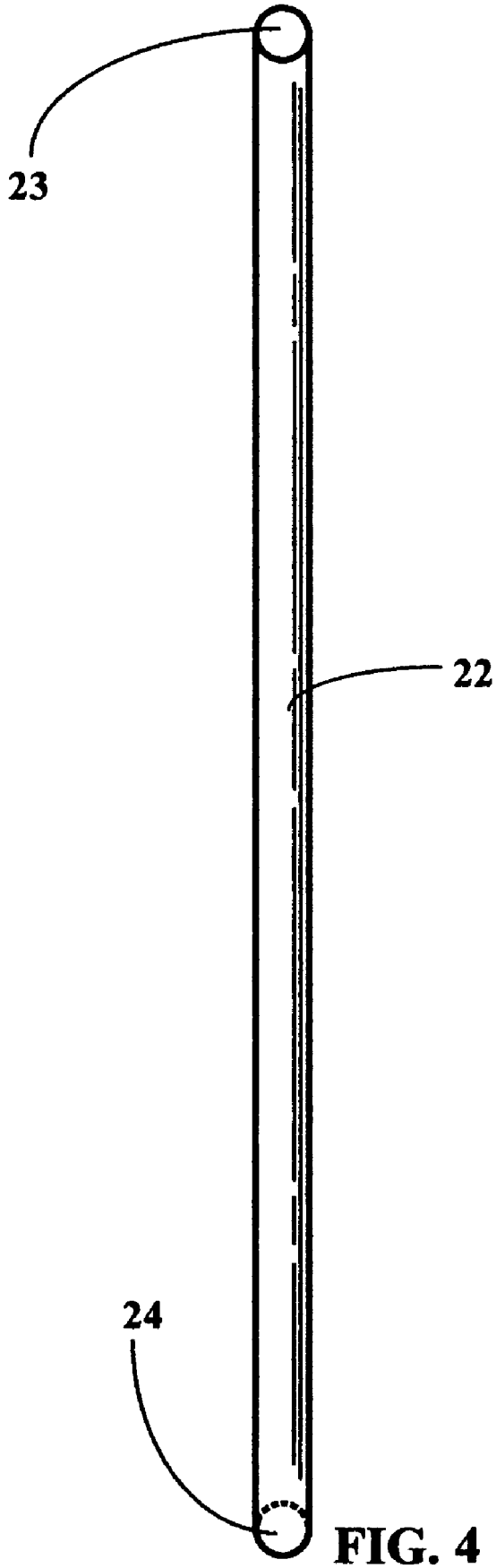
FIG. 4 is an end or side view of the rod baluster shown in FIG. 3.
Figure 5:
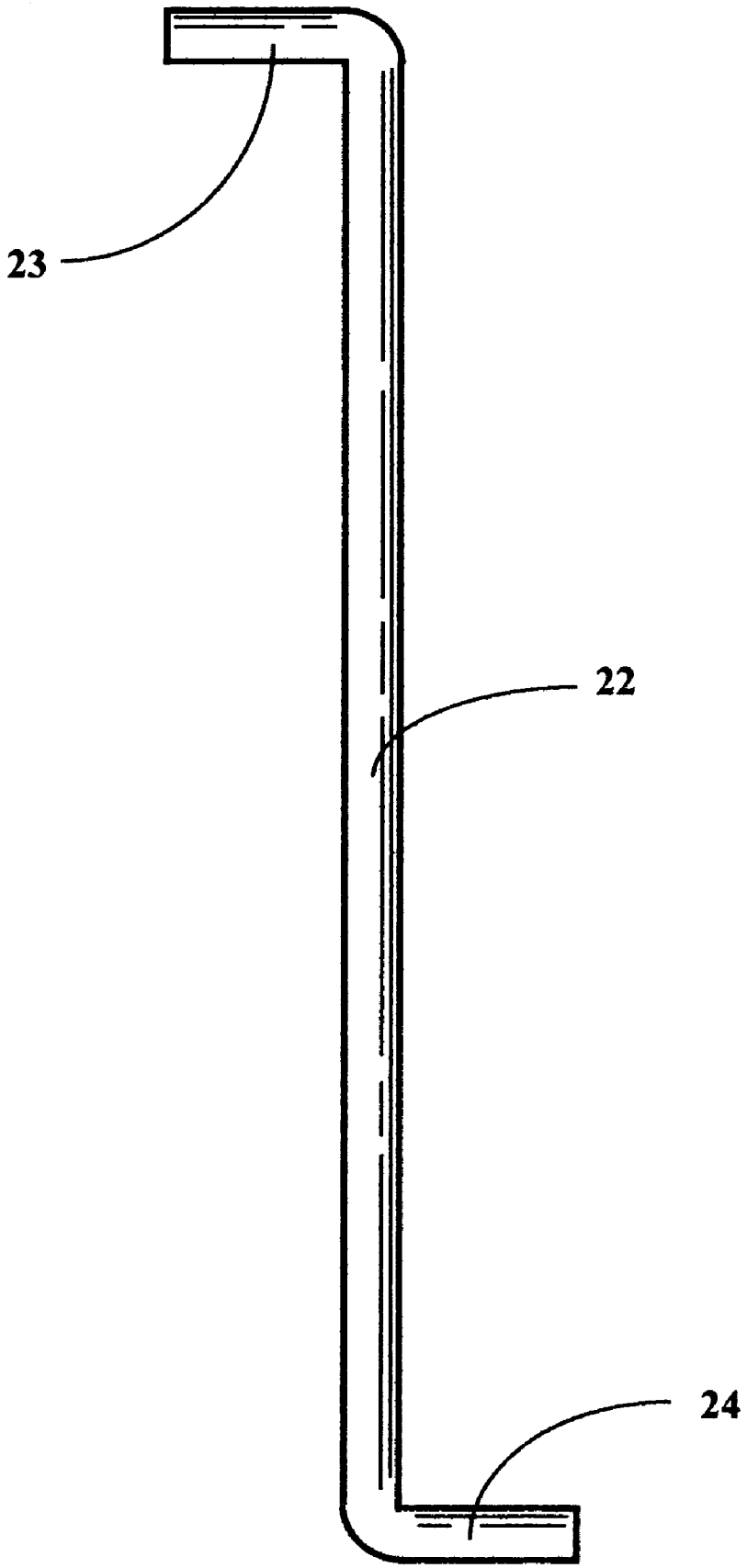
FIG. 5 is a view in front elevation of the rod baluster shown in FIG. 3.
Figure 6:
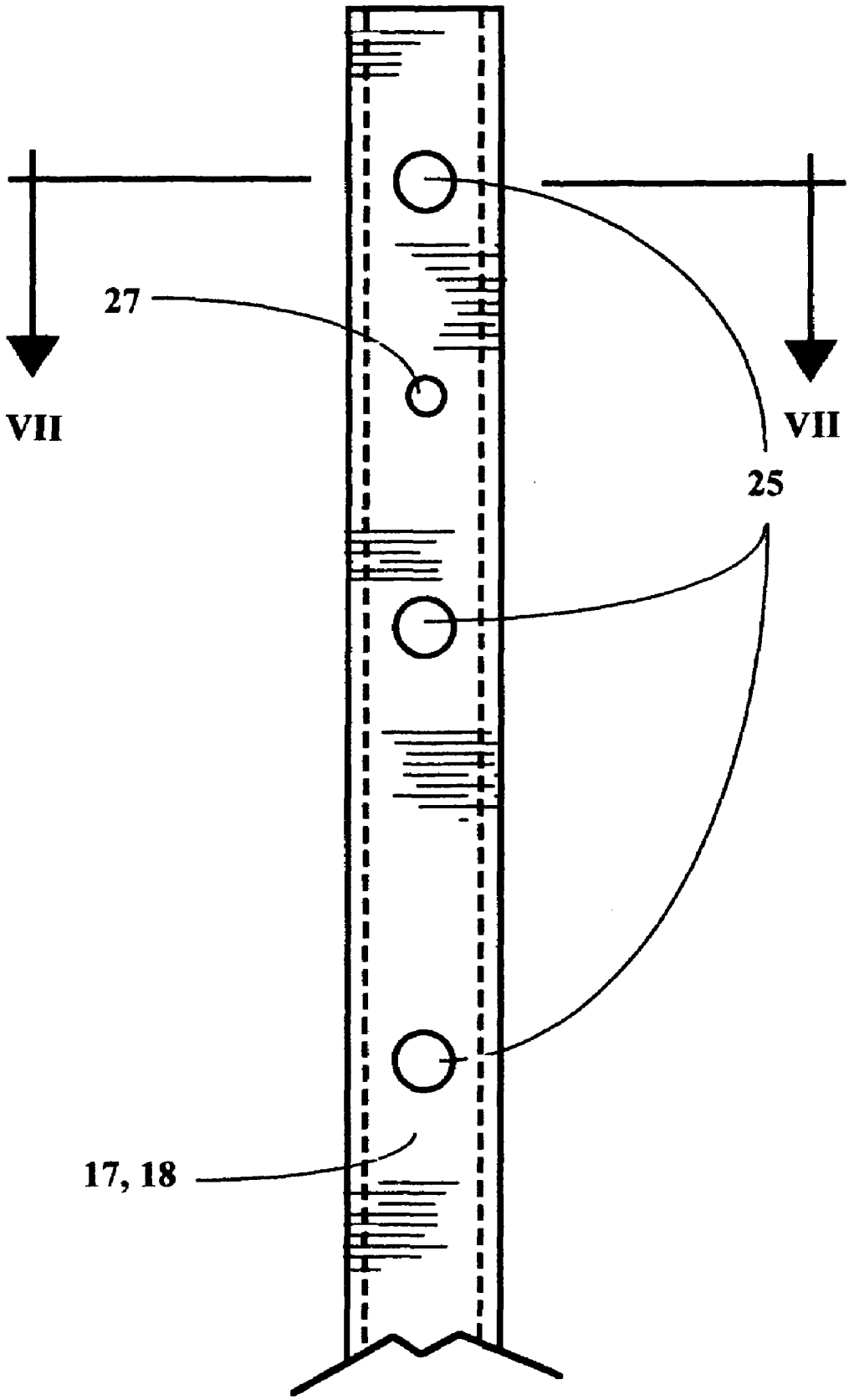
FIG. 6 is a bottom view of an upper channel of the railing system shown in FIG. 1.
Figure 7:
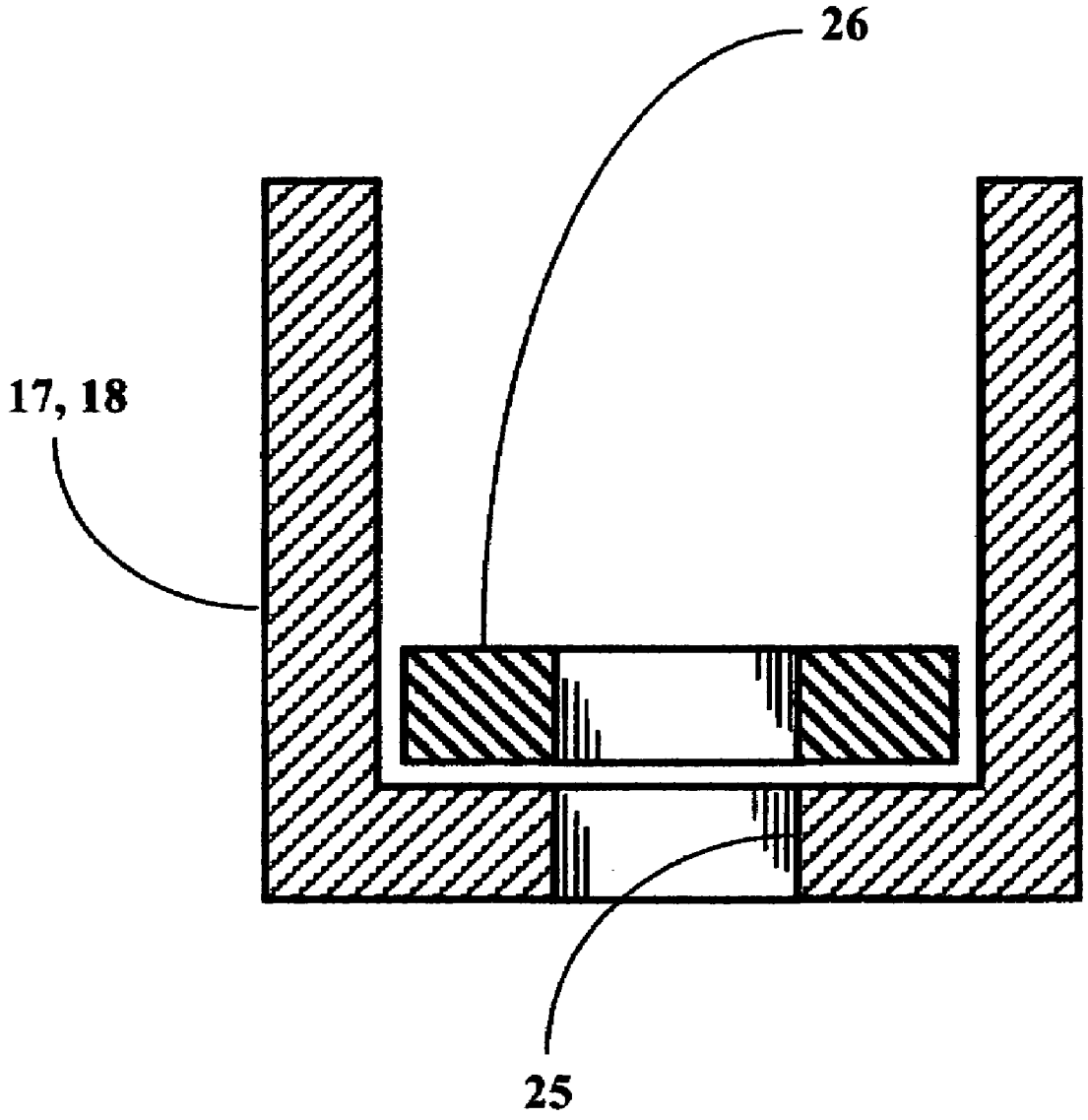
FIG. 7 is and end sectional view of the channel shown in FIG. 6 as seen along section line VII-VII.

Referring to FIGS. 1 through 7, the railing system 10 of the present invention is comprised of parallel spaced upper and lower rails 11 and 12 respectively, the top rail 11 having top and bottom sides 13 and 14 respectively and the bottom rail 12 having upper and lower surfaces 15 and 16 respectively. The rails 11 and 12 are supported in a conventional manner between spaced upright posts (not shown).

Upper and lower elongate channels 7 and 18 respectively, of identical configuration, respectively extend with upper and lower rails 11 and 12 as illustrated. The channels 17 and 18 each have an open side 20 which are respectively secured against the bottom side 14 of upper rail 11 and the top side 15 of lower rail 12 to thereby provide an enclosed elongate passage 21 in channels 17 and 18.

A plurality of parallel upright rod balusters 22 extend between the rails 11 and 12 and have upper and lower bent ends 23 and 24 respectively. The bend ends 23 and 24 in this embodiment are bent at right angles in order to align with the horizontal parallel railings 11 and 12. Spaced apertures 25 are provided in the channels 17 and 18 and receive the bent rod ends 23 and 24 therethrough with the bent ends received in the channel passages 21 for retention therein as illustrated.

Elastomer material 26 is positioned between each channel 17 and 18 on the interior thereof between the channels 17 and 18 and the respective rod bent ends 23 and 24 received therein in channel passages 21. The elastomer material 26 is provided in the form of a strip having apertures therein which are aligned with the channel apertures 25.

The bent ends 23 and 24 of rod balusters 22 are bent in opposite directions as illustrated in FIG. 1. This provides for easy manufacturing and easy assembly. However, it must be remembered that the bent rod ends 23 and 24 may, if desired, extend in the same direction. The respective channels 17 and 18 are secured to their respective upper and lower rails 11 and 12 by means of wood screws 27. The rod balusters 22 here illustrated are stainless steel. However, they may be of any desired material, such as plastic, iron or regular steel, and they may be of any desired cross sections such as round, square, oval, and if desired, may include additional fanciful design configurations.

Similarly, channels 17 and 18 are constructed of stainless steel and have a square cross sectional configuration. However, they may be made also of any suitable material, such as plastic, painted steel or the like and may have any other desired configurations, such as U-shaped, C-shaped, oval or round cross sectional configurations.

The rod balusters 22 provide a thin profile balustrade which minimally obstructs the view therebeyond. The railing system is also inexpensive to manufacture and easy to assemble.

Figure 8:
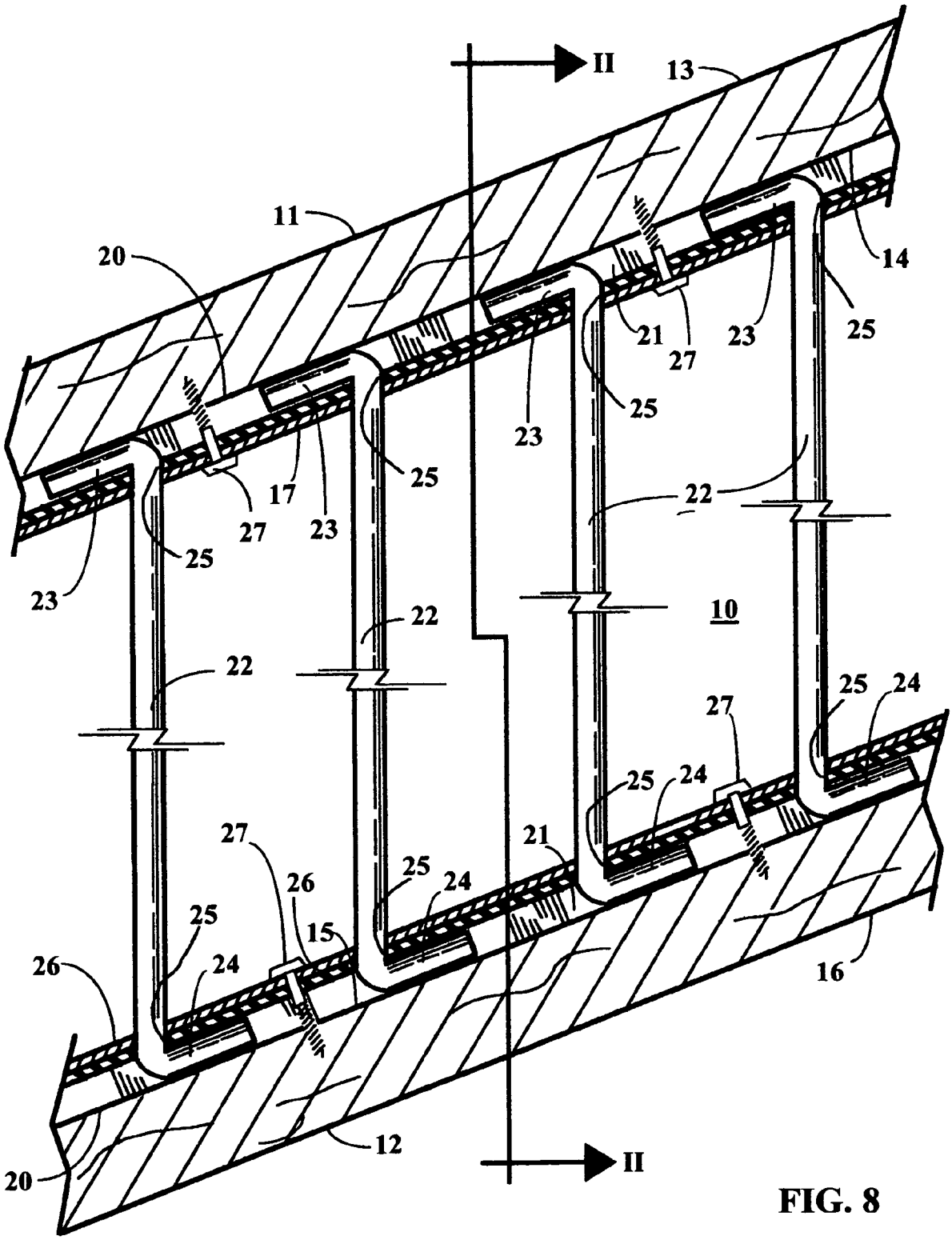
FIG. 8 is a view in front elevation of another embodiment of the railing system of the present invention illustrated on an incline for use with a stairway and as seen along the same vertical section lines as the structure of FIG. 1.

Referring to FIG. 8, the same railing system is illustrated, except in this embodiment the upper and lower parallel rails 11 and 12 are inclined for application to a stairway. In all respects, the railing systems are identical except that the bent rod ends 23 and 24 are not at right angles, but instead are inclined at the same angle as the rails 11 and 12. Generally this is approximately a 32° bend from horizontal.

Assembly of the railing system of the present invention is relatively easy and quick. For example, the balustrade made up of the rod balusters 22 and channels 17 and 18 may be readily assembled by first placing the channels horizontally back to back to each other and against each other with the respective elastomeric strips 26 positioned in their respective channels with the apertures all aligned with the apertures 25 of the channels. Then the upper bent end 23 of each respective rod baluster 22 is sequentially passed through the aligned aperture pairs of the channels 17 and 18 and the respective elastomeric strips 26 whereby the passed bent ends 23 are positioned in the upper channel passage 21 of upper channel 17. This is done sequentially for all of the rod balusters until they are all in place. Then the lower channel 18 is simply spread or dropped away from the upper channel 17 until it falls downwardly to engage the lower bent rod ends 24 whereby they are respectively received within the passage 21 of lower channel 18.

The balustrade is thus completely constructed and then simply secured to the upper and lower railings as illustrated with the wood screws 27 to the insides (bottom and top respectively) 14 and 15 of the parallel rails 11 and 12.

I claim:

1. A railing system comprising:

spaced parallel upper and lower rails, each with top and bottom sides and supported between spaced upright posts;

a plurality of parallel upright rod balusters extending between the rails and each said upright rod baluster having a constant cross-sectional shape and comprising an elongate intermediate portion having opposing elongate upper and lower bent rod ends which extend for a distance and at an angle away from said intermediate portion of said rod balusters in the direction of extension of said rails;

upper and lower elongate channels respectively extending with said upper and lower rails, each channel having an open side which is respectively secured against the bottom side of said upper rail and the top side of said lower rail, thereby providing an enclosed elongate passage in said channels;

spaced apertures in said channels receiving said elongate bent rod ends therethrough with said bent ends received in said channel passages in axial alignment in the direction of extension of said rails for retention therein, said spaced apertures dimensioned to be sufficiently large enough to permit insertion of and slidable passage of said upright rod balusters freely therethrough along the entire length of each said upright rod baluster along said intermediate portion between said upper and lower bent rod ends.

2. The railing system of claim 1, wherein said rails are horizontal and said bent rod ends are at right angles to said intermediate portions of said rod balusters.

3. The railing system of claim 1, wherein said rails are inclined and said bent rod ends are inclined at the same angle as said rails.

4. The railing system of claim 1, including elastomeric material positioned in each channel between said bent rod ends and said channels.

5. The railing system of claim 4, wherein said elastomeric material is in the form of a strip having apertures therethrough which are aligned with said channel apertures.

6. The railing system of claim 1, wherein said bent rod ends of each rod baluster are bent in opposite directions.

* * * * *